United States Patent [19]

Chase

[11] 4,248,916

[45] Feb. 3, 1981

[54] ARTIFICIAL CHRISTMAS TREE

[75] Inventor: Ascher Chase, Virginia Beach, Va.

[73] Assignee: General Foam Plastics Corp., Norfolk, Va.

[21] Appl. No.: 42,099

[22] Filed: May 24, 1979

[51] Int. Cl.[3] ..... A47G 33/06

[52] U.S. Cl. ..... 428/8; 211/205; 248/538; 428/20

[58] Field of Search ..... D11/118; 156/61; 211/196, 197, 205; 248/511-514, 538; 362/123; 403/171-172, 175-176; 428/7-9, 12, 18-20

[56] References Cited

U.S. PATENT DOCUMENTS

| | | | |
|---|---|---|---|
| 1,240,392 | 9/1917 | Vierlinger | 428/8 |
| 2,209,875 | 7/1940 | Eichelsdoerfer et al. | 248/513 |
| 3,033,504 | 5/1962 | Cronin | D11/118 X |
| 3,131,112 | 4/1964 | Abramson | 428/8 |
| 3,164,344 | 1/1965 | Whyte | 428/20 X |
| 3,278,364 | 10/1966 | Dieffenbach | 428/7 |
| 3,594,260 | 7/1971 | Dieffenbach | 428/20 |
| 3,813,277 | 5/1974 | Kleiman | 428/8 |
| 3,829,349 | 8/1974 | Hermanson | 428/20 X |
| 4,140,823 | 2/1979 | Weskamp | 428/20 X |

FOREIGN PATENT DOCUMENTS

| | | | |
|---|---|---|---|
| 581616 | 9/1958 | Italy | 428/20 |
| 55055 | 4/1935 | Norway | 428/20 |

*Primary Examiner*—Henry F. Epstein
*Attorney, Agent, or Firm*—Mandeville and Schweitzer

[57] ABSTRACT

Disclosed herein is a new and improved pole-branch holder sub-assembly for use in the construction of artificial Christmas trees. Specifically, the new pole-branch holder comprises an elongated cylindrical tubular member having selectively rotatable branch holder elements assembled therewith at predetermined elevations. The branch holders themselves are advantageously formed of high impact injection molded plastic and comprise sleeves, adapted to telescope the pole in close fitting relation thereto, having a plurality of integral uniformly spaced bosses with vertical bores therein, each of which bores are associated with cantilevered support channels extending radially outwardly from the bosses. The new pole branch holder sub-assembly enables an artificial Christmas tree to be assembled rapidly by user merely by dropping the pre-formed bent ends of conventional twisted wire branches into the well-defined, multi-axis support established by the combination of the vertical bore and intersecting channel. Ease of assembly is enhanced by appropriately coding the inner bent ends of the branches for each elevation of the tree with the branch holder located at that elevation.

14 Claims, 16 Drawing Figures

ARTIFICIAL CHRISTMAS TREE

BACKGROUND AND SUMMARY OF PRESENT INVENTION

Artificial Christmas trees, generally comprising a wooden pole, having drilled canted holes, into which holes twisted wire branches are inserted, are well-known to the art. This type of tree is ordinarily the least inexpensive of a myriad of knock-down, artificial trees presently manufactured by the artificial tree industry and employed by the general public. The artificial tree construction in which the bent end of a twisted wire branch is inserted into a drilled wooden pole is known to the art as a "stick-in" type of tree and is well illustrated in U.S. Pat. No. 3,278,364.

Disclosed herein is a new and improved, injection molded branch holder sleeve, which will greatly contribute to the elimination of problems heretofore associated with "stick-in" trees. The problems with such stick-trees have involved hole location and sizes, i.e. the holes are difficult to align, to space, and to drill into wooden poles; when drilled, the hole sizes often tend to be either too large or too small, in which case the branch end cannot be easily inserted into the hole, or the branch will tend to rotate or to sway in the hole, respectively.

The sizes and uniformity of the drilled holes themselves are subject to variation. The wood may swell, reducing the size of the drilled hole; the insertion and rotation of a branch or the repeated insertion and removal of a branch will tend to enlarge the hole. Thus, there are substantial problems associated with "stick-in" trees in which holes are drilled into wooden poles.

The present invention eliminates those problems of "stick-in" trees by the substitution of unitary molded plastic branch holder sleeves having vertical holes and related cantilivered U-shaped channels associated therewith in lieu of each of the angled holes presently employed by stick-in poles. The use of a vertical hole, which may be slightly "sloppy" or "over-sized", in association with an open channel, allows quick and easy insertion of pre-formed bent branch ends into the hole, yet prohibits rotation or wobble, as well as accommodating variations in wire sizes and twisted wire variation. This is accomplished by the formation of the female or receiving member along two intersecting axes, rather than along the single axis provided by the drilled hole in the state of the art "stick-in" tree.

The new branch holder, which also is an improvement over earlier, known branch holders, may be fastened or otherwise attached to a trunk pole (of wood, plastic, or metal) at predetermined levels by a connector means such as notches or resilient split-ring formed integrally therewith and adapted to cooperate with lock means such as a pin, a ring, or a circumscribed groove on the pole. This arrangement allows the entire sleeve to be selectively rotated on the pole itself to aid in the shaping and aesthetic balancing of the tree; and if a simple friction-type of clamping is used to secure the branch holder to the tree, the sleeve may be selectively, vertically displaced along the pole in addition to being rotated. Thus, the branch receiving elements of the new tree assembly may, to a limited degree, be located, as desired, to enhance shaping, as contrasted with the absolutely fixed location of the drilled holes in a "stick-in" pole.

In alternative embodiments of the new tree assembly, the sleeve holder itself may be formed integrally with a plastic trunk pole or trunk pole segment or it may be permanently fastened to or otherwise assembled with a pole by conventional mechanical fastening means, adhesives, or the like.

For a more complete understanding of the present invention and a better appreciation of the attendant advantages to be derived from its practice, reference should be made to the following detailed description of the invention in conjunction with the accompanying drawings.

DETAILED DESCRIPTION OF THE INVENTION

Figure 1:
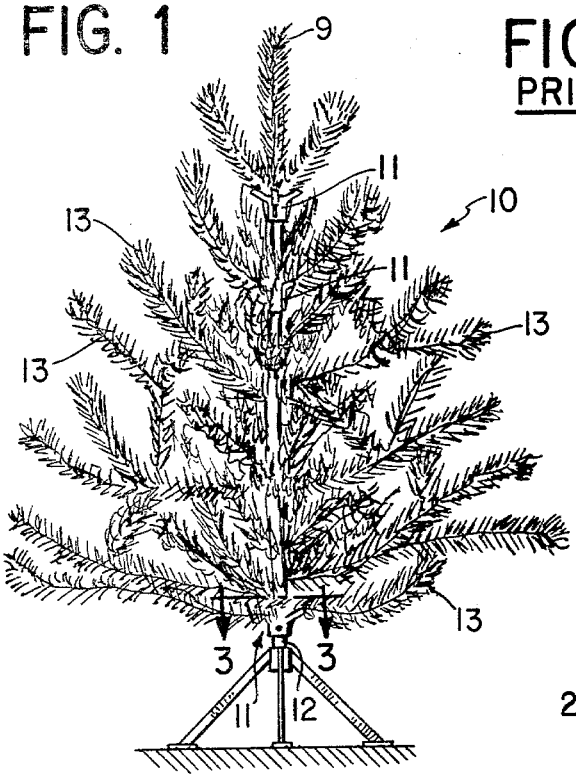
FIG. 1 is a side elevational view of a knock-down artificial Christmas tree, including a plurality of the new branch holder sleeves of the present invention.

Referring now to FIG. 1, a knock-down artificial Christmas tree 10 of the present invention may be readily assembled from a plurality of new and improved injection molded, plastic branch holder sleeves 11 attached to a central trunk pole 12 and from a plurality of twisted wire branches 13 having bent ends inserted into the sleeves 11. A conventional tree top 9 is simply inserted into or otherwise attached to the uppermost portion of pole 12 by a suitable connector (not shown).

Specifically, the pole 12 advantageously is an undrilled cylindrical pole of metal, plastic, or wood, having a series of annular grooves 14 formed thereon at predetermined elevations. The new branch holder sleeves 11 are slipped over the end of pole 12 and snapped into place at each of the predetermined levels of branches which are established by the grooves 14 or by alternative connector means illustrated in FIGS. 6-16 and as will be explained in detail hereinafter. More specifically, the branch holders 11 comprise a tubular cylindrical plastic hub 15, the lowermost portion of which is divided into a series of fingers 16, having inwardly projecting locking tip portions 17, which extend slightly inwardly of the inner diameter 18 of the hub. As will be understood, the tubular hub 15 is sized to slide over the pole 12 to its desired position, where the fingers 16 will snap lock in engagement with the groove 14. The natural resilience of the thermoplastic material from which the sleeve 11 is injection molded, advantageously provides an inherent inward bias or inward spring action of the fingers 16. As will be understood in lieu of the use of fingers 16 cooperating with a groove 14, the sizing of the inner diameter of the hub 15 with respect to the outer diameter of the pole 12 may be related such that the holder 11 will be secured to the pole 12 by a friction fit or by any of the alternative arrangements shown in FIGS. 6–16. Regardless of the specific arrangement employed to secure the sleeve 11 to the pole 12 at a desired height, the fit of the sleeve 11 to the pole is such that the sleeve itself may be rotated with respect to the pole to contribute substantially in the final shaping of the assembled tree.

Figure 3:
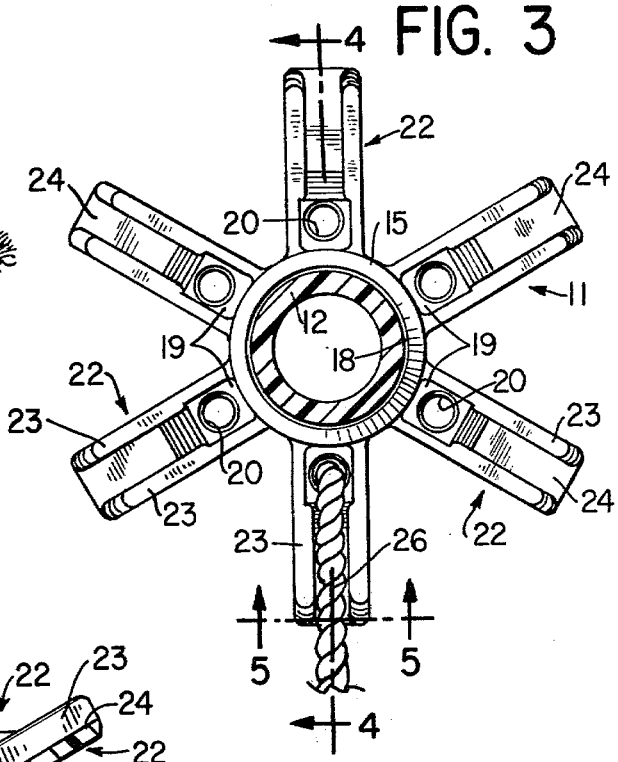
FIG. 3 is a plan view of a preferred embodiment of the new pole-branch holder sleeve sub-assembly of the present invention.
Figure 5:
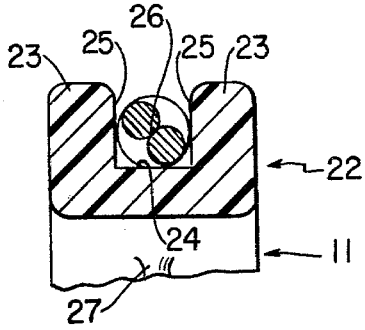
FIG. 5 is an enlarged cross-sectional view of an arm of the new branch holder of FIG. 3 taken along lines 5—5 of FIG. 3.

In accordance with the invention, a series of bosses 19 are arrayed in equidistant spacing about the hub 15 as shown in FIG. 3. The bosses define vertically extending axial bores 20 therein which receive the lowermost bent ends 21 of the twisted wire branches 13, which may be coded by a color coating 21' or otherwise, to indicate the specific holder 11 (and hence tree elevation) into which is it to be inserted. Advantageously, the major axis 26 of the twisted wire branch 13 forms a predetermined angle "A", advantageously of approximately 105 to 125 degrees. Extending upwardly and outwardly from the bosses 19 are a series of channels 22 having vertical parallel side walls 23 interconnected by a horizontal bottom wall 24 in a manner providing the channels 22 with a generally U-shaped cross section as shown in FIG. 5.

Figure 4:
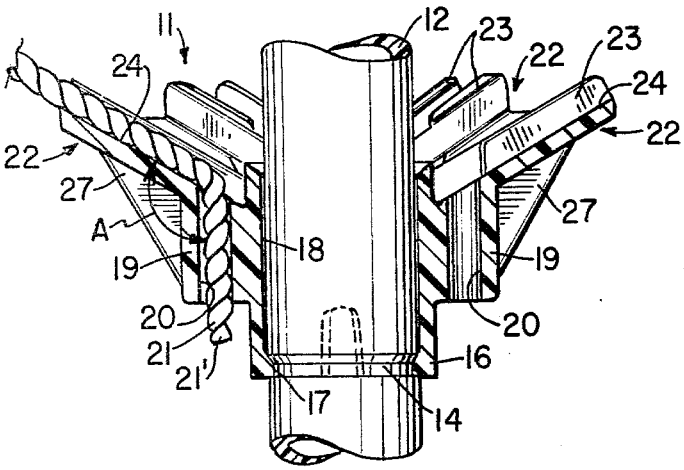
FIG. 4 is a cross-sectional view of the new pole-branch holder sub-assembly sleeve of FIG. 3 taken along lines 4—4 of FIG. 3.

As shown best in FIG. 4, the innermost ends of the twisted wire branches 13 are bent in a manner such that the lowermost portions 21 of the branches are generally parallel to the axis of the pole 12. Thus, each of the twisted wire branches may be simply and quickly dropped into or otherwise easily inserted into the branch holder 11 merely by lowering the bent end of the twisted branch 13 over the channel means 22 so that the generally vertical lower branch end 21 passes through the bore 20 while the angled main limb twisted wire 26 rests firmly in the channel 22. The angle "A" of the bent end of the branches 13 is, of course, the same as the angle "A" formed between the bore 20 and the channel 22.

Figure 2:
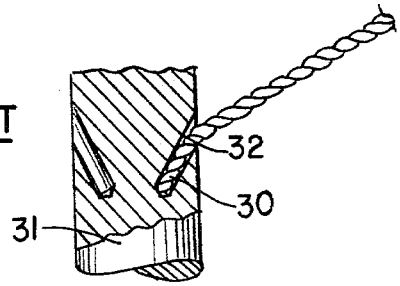
FIG. 2 PRIOR ART
FIG. 2 is an enlarged cross-sectional view of a drilled wooden pole showing the prior art "stick-in" connection of bent twisted wire branch to pole.

Advantageously webs 27 reinforce the branch holder at those junctures of the channels 22 and the bosses 19. The channel wall surfaces 25 will engage the limb portion 26 and in cooperation with the bore 20 will prevent the wobbling, swaying, twisting or lateral displacement of the branch 13 with respect to the trunk 12. As will be appreciated, this represents a substantial improvement over the prior art arrangement shown in FIG. 2 where the twisted wire end 30 of a branch may rotate in or wobble with respect to the pole 31 and the drilled hole 32 into which the end 30 is placed.

As shown in FIG. 3, the illustrated holder 11 has six channels and bores equidistantly spaced about the sleeve; however, it should be understood that, depending upon the size and shape of the tree and the elevation of the branch holder and/or other factors, the specific number of channels and bores employed may be varied as found desirable or necessary. In other words, the lowermost branch holder of a large tree may have more channels than the uppermost branch holder, since natural trees have more and larger branches at the bottom than at the top.

Figure 6:
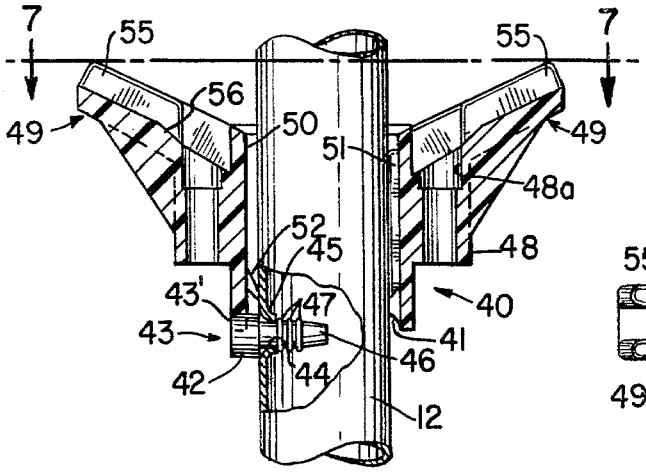
FIG. 6 is a cross-sectional view of an alternate preferred embodiment of the new pole-branch holder sleeve sub-assembly of the present invention.
Figure 7:
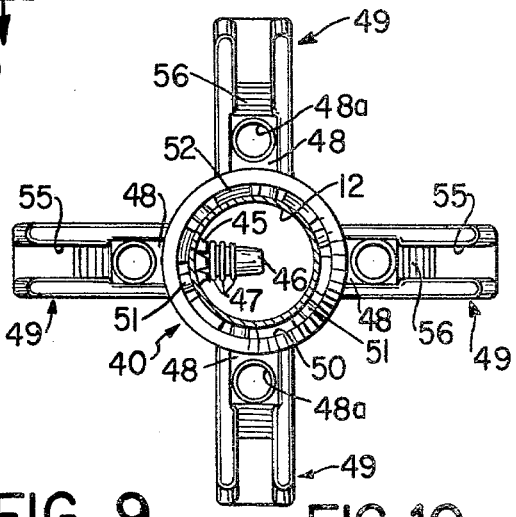
FIG. 7 is a plan view of the sub-assembly of FIG. 6.
Figure 8:
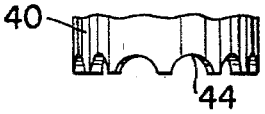
FIG. 8 is a fragmentary side elevational view of the branch holder sleeve of FIG. 6.

FIGS. 6 through 8 illustrate an alternative preferred embodiment of the new pole-branch holder sub-assembly of the present invention. The branch holder sleeve 40 shown in FIG. 6 generally is similar to the branch holder 11 shown in FIGS. 3–5 insofar as the angled interrelationships of the vertical bores and holding channels are concerned. The branch holder 40, however, has four bosses 48 and channels 49 and is attached to the pole 12 in a somewhat different manner. Specifically, in lieu of the resilient fingers 14, the lower edges of the branch holder sleeve 40 are scalloped as shown in FIG. 8 to define a series of semi-circular lock-notches are the same as that of the cylindrical head 42 of a locking pin 43, permanently secured to the pole 12 by insertion through a hole 44 formed therein. In the illustrations of FIGS. 6 and 7, the pole 12 is a hollow, tubular metal pole and the aperture 44 is formed by a conventional punching operation which forms a cylindrical split collar 45 by virtue of the punching operation. Advantageously, the locking pin 43 has a tapered inner end 46 having integral locking rings 47 formed thereon in a manner whereby the insertion of the locking pin 42 into the apperture 44 results in the permanent attachment of the pin to the pole. The pin itself, which advantageously may be formed of high impact plastic materials may be provided with a color coated coding 43' for the purposes described hereinabove in the subsequent assembly of color coded twisted wire branches to the pole.

Advantageously the inner diameter 50 of the sleeve 40 is somewhat larger than the outer diameter of the pole 12, with the difference therebetween being compensated for by the inclusion of a series of vertical friction gripping ribs 51 formed integrally therewith. Intermediately, the vertical spaced ribs 51 are friction gripping pads 52 which extend circumferentially about the inner surfaces of the sleeve as shown in FIG. 7.

In accordance with the invention, the sleeve 40 may be telescoped over the pole 12 until one of the circular notches 41 contacts the head 42 of the pin 43 to lock the branch holder in place at the pre-determined level of the pole established by the locking pin 43. In the subsequent assembly of branches to the holder 40 or thereafter if it is desired to rotate the holder 40 with respect to the pole, this may be simply accomplished by sliding the holder 40 upwardly of the pin to free the notches 41 therefrom, then turning the holder 40 about the pole to a desired selected position (to enhance shaping of the tree), and then finally sliding the branch holder downward to re-engage one of the notches 41 with the head 42 to relock the branch holder in its newly selected position.

To enhance branch end insertion, the bores 48 are provided with an enlarged diameter upper portion **48*a* while the inner walls 55 of the channels 49 are spaced slightly farther apart at the intersection of the channels 49 and bore 48*a* as shown best in FIG. 7. Additionally, the inner end of the lower channel wall 56 is canted to provide superior accommodation of the bent inner ends 21 of the twisted wire branches 13**.

FIGS. 9 through 16 show alternative locking arrangements to those shown in FIGS. 4 and 6. For example, in FIG. 9 the lower end of the branch holder sleeve if provided with an internal shoulder 60 which cooperates with a C-shaped locking ring 61 having a beveled inner edge 62 which is snapped into place in a correspondingly beveled circumferential groove 63 on the pole 12. Thus, it will be understood in the embodiment of FIGS. 9 and 10 the branch holder is simply slipped over the pole until the shoulder 60 formed on the inner surface of the sleeve engages the periphery of and the upper annular surface 64 of the ring 61.

Figure 9:
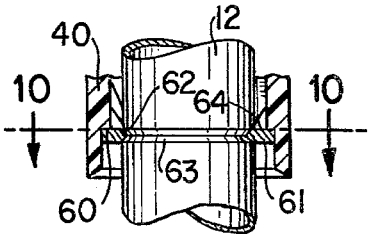
FIG. 9 is a fragmentary cross-sectional view showing an alternate configuration of a pole-sleeve attachment.
Figure 10:
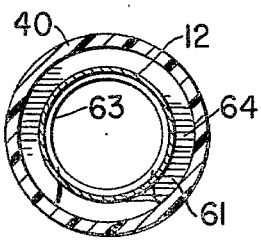
FIG. 10 is a cross-sectional view taken along lines 10—10 of FIG. 9.
Figure 11:
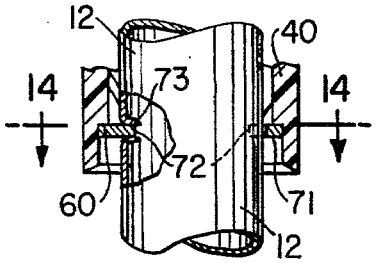
FIGS. 11 through 13 are fragmentary cross-sectional views showing further alternative arrangements of the pole-sleeve branch holder interconnections.
Figure 14:
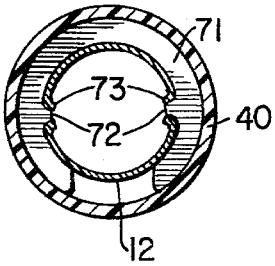
FIGS. 14 through 16 are cross-sectional views taken along lines 14—14, 15—15, and 16—16, respectively, of FIGS. 11 through 13.

FIGS. 11 and 14 show a further alternative to the arrangement of FIGS. 9 and 10 wherein, in lieu of a C-ring 61, which is engaged in a groove 63, a C-ring 71 is employed, which ring has inwardly projecting detents 72 which are snapped into apertures 73 formed in the pole 12. In this arrangement, the shoulders 60 formed at the lower end of the branch holder sleeves engage the periphery of and the upper annular face of the ring 71 at predetermined levels of the tree.

Figure 12:
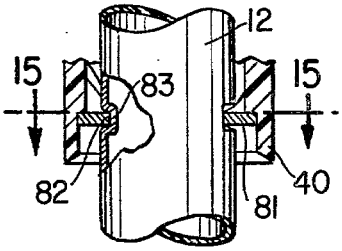
Figure 15:
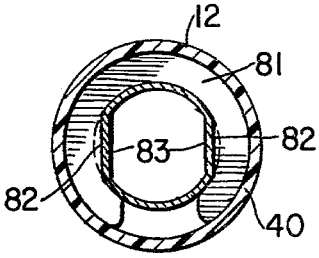

FIGS. 12 and 15 show yet another alternative embodiment wherein a split C-ring 81 is snapped into two flat parallel grooves 82 formed on the pole 12; the C-ring 81 has parallel flats 83 which engage the parallel flats 82 formed on the pole 12. As will be appreciated the flats are very easy to form on a trunk pole regardless of its construction.

Figure 13:
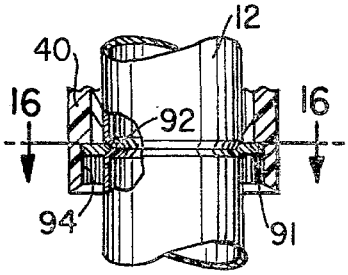
Figure 16:
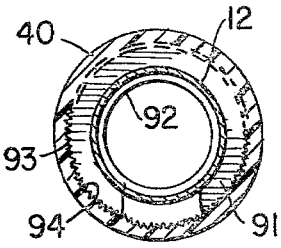

A still further modification of the branch holder of the present invention is shown in FIGS. 13 and 16 wherein a serrated split C-ring 91 is engaged in an annular grove 92 formed on the pole 12. The serrations 93 of the ring 91 are adapted to be engaged with mating serrations 94 formed on the lower internal surfaces of the branch holder sleeve. This arrangement, as will be understood, provides selective rotation of the branch holder sleeve with respect to the pole in a ratchet-like manner.

While the sleeves illustrated in FIGS. 9, 11, 12, and 13 are all shown with shoulders 60 which engage the peripheries and upper surfaces of a C-ring, a circumferential groove may be employed in lieu of the shoulder in a manner whereby the sleeve may be locked to the pole by the snapping of the circumferential groove over the periphery of the C-shaped locking ring in a manner engaging both the upper and lower surfaces of the C-ring.

It should be understood, of course, that the specific forms of the invention herein illustrated and described are intended to be representative only, as certain changes may be made therein without departing from the clear teachings of the disclosure. Accordingly, reference should be made to the following claims in determining the full scope of the invention.

I claim:

1. In an artificial tree assembly having a vertical trunk pole mounting groups of twisted wire branches having their inner end portions permanently bent at a predetermined angle, the improvement comprising;

(a) a plurality of unitary branch holders mounted in predetermined mutual spaced relation along said trunk;

(b) each holder having a central tubular sleeve having an inner diameter substantially equal to the outer diameter of said trunk pole;

(c) a plurality of bosses arranged equidistantly about the outer surfaces of said sleeve;

(d) each of said bosses defining an elongated axial bore therein; and (e) integral, cantilivered channel means extending outwardly and upwardly from each boss at a predetermined angle substantively equal to said predetermined inner branch end angle;

(f) whereby the angularly related walls of each axial bore and associated channel means of each holder are adapted to receive, to engage, and to maintain the angularly related surfaces of the bent ends of groups of said twisted wire branches at predetermined levels along said trunk pole while accommodating selective rotation of said groups of branches about said pole for tree shaping.

2. The assembly of claim 1, further characterized in that —

(a) said channel means are provided with a generally U-shaped cross section having a width sufficient to accommodate the diameter of the twisted wire inner ends of said branches.

3. The assembly of claim 2, further including (a) web means joining said U-shaped channels and said bosses.

4. The assembly of claim 1, further characterized in that (a) said axial bores are generally parallel to the axis of said trunk pole.

5. The assembly of claim 4, in which (a) said bores have enlarged upper portions and reduced diameter lower portions.

6. The assembly of claim 1, in which (a) the lowermost portions of said sleeve define at least one notch;

(b) pin means mounted on said pole;

(c) said notch engaging said pin means to locate and to hold said sleeve on said pole.

7. The assembly of claim 1, in which (a) a series of semi-circular notches are defined at the bottom of said sleeve;

(b) a series of locking pin means having cylindrical heads of diameter equal to that of said semi-circular notches are mounted on said pole at predetermined elevations;

(c) said cylindrical heads engaging selected ones of said notches to locate said sleeves with respect to said pole.

8. The assembly of claim 1, in which (a) each of said sleeves includes an integral split-ring connector for gripping said trunk;

(b) said split-ring connector includes a plurality of axially extending fingers; and (c) the inner surfaces of the ends of said fingers lying in a circle and having a diameter less than that of the remainder of said sleeve.

9. The branch holder of claim 1, further characterized by (a) said fingers being biased inwardly toward the vertical axis of said trunk.

10. The branch holder of claim 9, further characterized in that (a) each of said fingers have an inwardly projecting portion on the lower inner surface thereof;

(b) said trunk has annular grooves formed thereon at predetermined locations therealong; and (c) said fingers are engaged in said grooves to secure said branch holders to said trunk at said locations.

11. A branch holder for mounting groups of twisted wire of predetermined diameter and having inner ends bent at a predetermined angle, comprising:

(a) a unitary tubular sleeve;

(b) a plurality of bosses formed integrally with outer surface portions of said sleeve and arranged symmetrically thereabout;

(c) each of said bosses defining an elongated axial bore therein;

(d) integral cantilevered channel means extending outwardly and upwardly from each boss;

(e) the diameter of said bores and the width of said channel means being substantially that of the diameter of said twisted wire;

(f) said bores and said channel means intersecting at said predetermined angle to provide regularly related branch support surfaces.

12. The holder of claim 11, in which (a) said predetermined angle is approximately 105–125 degrees.

13. The holder of claim 12, in which (a) said bores are substantially vertically aligned.

14. The holder of claim 11, in which (a) integral pole mounting means are formed on said sleeve.

* * * * *

UNITED STATES PATENT AND TRADEMARK OFFICE

CERTIFICATE OF CORRECTION

PATENT NO. : 4,248,916

DATED : February 3, 1981

INVENTOR(S) : Ascher Chase

It is certified that error appears in the above-identified patent and that said Letters Patent are hereby corrected as shown below:

Column 5, line 67, delete "cantilivered" and insert --cantilevered-- in its place.

Column 6, line 1, change "substantively" and insert --substantially-- in its place.

Column 6, line 51, delete "claim 1" and insert --claim 8-- in its place.

Column 6, line 64, after "wire" insert --branches--.

Column 8, line 2, delete "regularly" and insert --angularly-- in its place.

Signed and Sealed this

*Twenty-first* Day of *April 1981*

[SEAL]

*Attest:*

RENE D. TEGTMEYER

*Attesting Officer*

*Acting Commissioner of Patents and Trademarks*